United States Patent [19]

Gutschneider

[11] 3,949,569

[45] Apr. 13, 1976

[54] RING WITH BEZEL SECURED BY THE DECORATIVE MEMBER IT SURROUNDS

[75] Inventor: Jack Gutschneider, White Plains, N.Y.

[73] Assignee: Jack Gutschneider Jewelry Co., Inc., New York, N.Y.

[22] Filed: Aug. 16, 1974

[21] Appl. No.: 497,855

[52] U.S. Cl. ..... 63/15; 63/26

[51] Int. Cl.[2] ..... A44C 9/00

[58] Field of Search ..... 63/15, 26, 29 R, 29 M

[56] References Cited

UNITED STATES PATENTS

| | | | |
|---|---|---|---|
| 1,232,986 | 7/1917 | Simson | 63/15 |
| 1,731,786 | 10/1929 | Mountford | 63/15 |
| 1,830,619 | 11/1931 | Patt | 63/15 |

*Primary Examiner*—Louis G. Mancene

[57] ABSTRACT

A ring is constructed which comprises a circular member through which a person's finger fits, side members extending upwardly from the circular member, a top portion, one end of which is secured to each side member and at least a part of which extends over the circular member, a support member attached to the top portion of the circular member, a plate member attached to the support member, a bezel, and a decorative member disposed within said bezel, said decorative member being secured to said plate member. As a variant, there may be two plate members, each secured to the top of a side member and the support member may extend up to and be secured to a top portion which extends over at least a part of each plate member.

7 Claims, 8 Drawing Figures

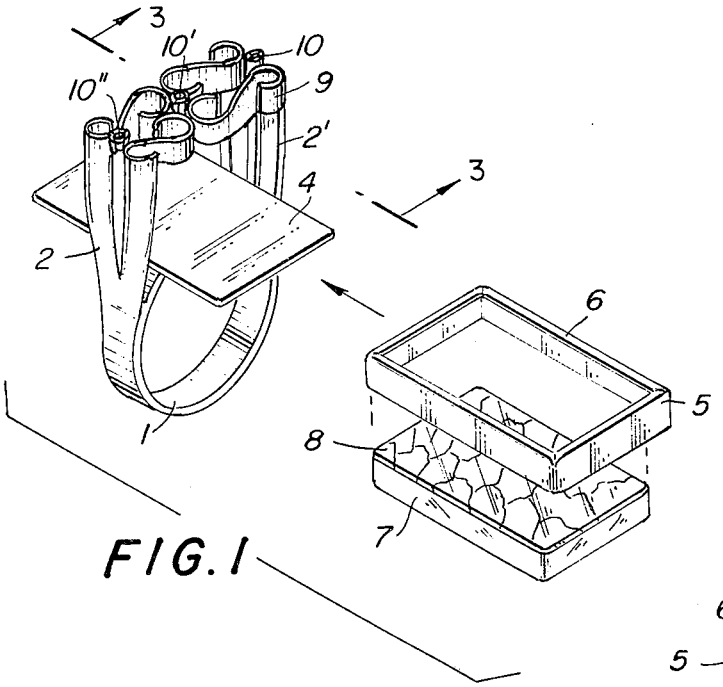
FIG. 1
FIG. 3
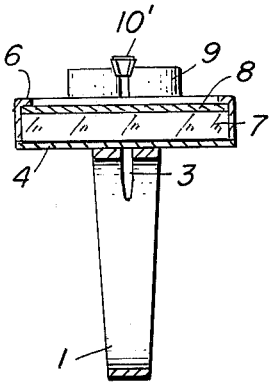
FIG. 2
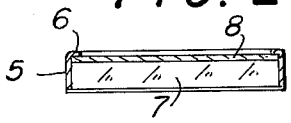
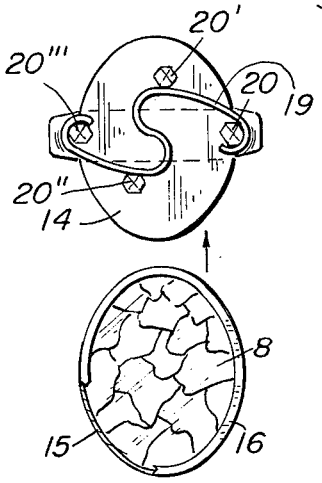
FIG. 4
FIG. 7
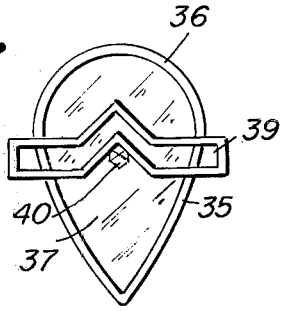
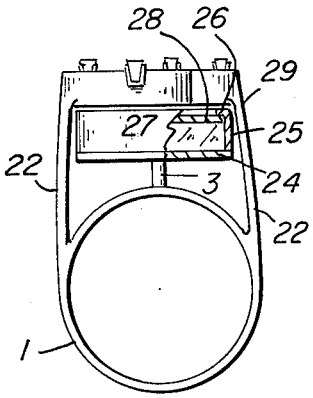
FIG. 6
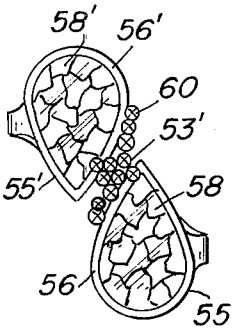
FIG. 8
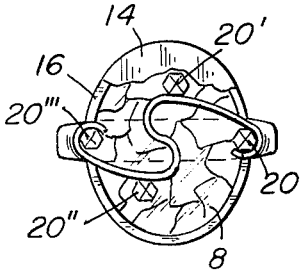
FIG. 5

RING WITH BEZEL SECURED BY THE DECORATIVE MEMBER IT SURROUNDS

The present invention is concerned with rings. More particularly, the present invention is concerned with rings which may have a precious, semi-precious or aesthetically pleasing stone or other decorative member which is held in place between the circular member which is placed on a person's finger and a top member to the ring by a plate member. The precious stone, semi-precious stone or other decorative piece is inserted into a bezel and then secured on to the plate member. The construction of the instant ring thus represents an advance in the art by providing a simple and economical construction while at the same time providing a method of securely holding a precious, semi-precious or other stone or decorative member in the ring structure.

FIG. 1 shows a ring according to the present invention in enlarged elevational view.

FIG. 2 shows a decorative member insertable in a bezel according to the present invention.

FIG. 3 is a view of the ring of FIG. 1 taken along the lines 3—3.

FIG. 4 is a top view of another ring according to the present invention and a decorative member inserted in the bezel.

FIG. 5 is a top view of the ring of FIG. 4 in partial breakaway showing the decorative member in the bezel secured to the plate member.

FIG. 6 is a side view of another ring according to the present invention.

FIG. 7 is a top view of another ring according to the present invention.

FIG. 8 is a top view of a further modification of the ring of the present invention.

Referring more particularly to the drawings, in FIG. 1 a ring is shown which comprises a circular member 1 through which a person's finger fits having two side members 2 and 2′ each one of which extends upwardly from one side of the circular member toward the top portion of the ring. Plate member 4 is secured to circular member 1 by a support member such as support 3 shown in FIG. 3. Support member 3 has one end secured to the top of circular member 1 and the other end secured to the underside of plate member 4. Top portion 9 extends across plate member 4 and in FIG. 1 is integral with the two side members. Top portion 9 may have decorative precious stones, semi-precious stones or other decorative materials such as shown at 10, 10′ and 10″ in FIG. 1 secured thereto. A decorative member, which may either be a solid precious stone, semi-precious stone or other decorative piece such as 37 shown in FIG. 7 or which may comprise a suitable backing material such as a glass backing 7 (FIG. 1 and FIG. 2) to which is secured stone or other suitable chips 8 (FIG. 1 and FIG. 2), is then inserted into a bezel 5 which has a flange 6 to prevent the decorative member from moving out of the bezel, the bezel being of the same configuration as the decorative member. The decorative member in the bezel is then secured on to the plate member 4 such as by cement so that cement may be placed on the underside of the decorative member, for example, as shown in FIGS. 2 and 3. The cement holds the decorative member in the bezel on the plate member 4, plate member 4 being of the same size and shape as the decorative member. The top portion holds the bezel, and hence the decorative member, in a firm position.

FIG. 4 shows an alternative embodiment of the present invention wherein the decorative member comprises a backing material and suitable stone chips 8 secured thereto and bezel member 15 having flange 16, all oval in configuration as is plate 14. Top portion 19 is of a different configuration and has suitable decorative precious stones 20, 20′, 20″ and 20‴ secured thereto.

FIG. 6 shows a side view of a further embodiment of the present invention wherein top portion 29 is integral with side members 22, support 3 is secured at one end to circular member 1 and at the other end to plate member 24 and a decorative member comprising a backing material 27 and decorative material 28 secured thereto is inserted into bezel 25 having flange 26.

FIG. 7 shows a further embodiment of the present invention wherein the plate member, the bezel 35 having flange 36, and the decorative member 37 are all pear-shaped. The decorative member 37 can be a precious stone, semi-precious stone or other substantially uniform decorative piece. Top portion 39 shows an alternative configuration having a decorative precious or semi-precious stone 40.

FIG. 8 shows an alternative embodiment of the present invention wherein plate members are secured to the top of each side member and decorative members are inserted into bezels 55 and 55′ having flanges 56 and 56′ respectively. Support member 53′ extends upwardly between the two plate members and top portion 60 is secured to support member 53′ and extends over at least a portion of each bezel. The decorative members comprise backing such as 7 to which is secured stone or other chips 58 and 58′. The combination is inserted into bezels 55 and 55′ similar to the manner shown in FIG. 1.

To construct the ring according to the present invention, the circular member having the two side members extending upwardly from each of the circular members are constructed and the top portion may be either integral with one or both of the side members or may be attached after construction of the initial step. The support member is secured to the top of ring portion and then the plate member is attached to the support member, except in the case of the embodiment of FIG. 8 wherein a plate member is attached to each of the side members. The decorative member, which may comprise decorative member 38 or decorative member comprising backing material 7 with chips secured on the top thereof 8, is inserted into a bezel having a flange and then the decorative member in the bezel is placed on the plate member and secured, such as by cementing. The top member contacts the top portion of the bezel member to provide additional security to the bezel and decorative member.

In another embodiment the top portion comprises one portion integral with one side member and extending across only a part of the plate member and a second portion integral with the other side member and extending across a part of the plate member.

What is claimed is:

1. A ring which comprises a continuous circular member through which a person's finger fits; two substantially parallel side members, one extending upwardly from each side of the circular member; a top portion extending between and secured to the outer ends of said side members so that the side members, top portion and the portion of the circular member extending between the side members form a defined space; a plate member having an upper surface and a lower surface; a support member, one end of which is secured to the top of the circular member and the other end of which is secured to the plate member so that the plate is fixed in said space with the upper surface of said plate member spaced from the lower surface of said top portion and said top portion extending over at least a part of the plate member; a bezel and a decorative member disposed within said bezel, said decorative member being secured to said plate member, said bezel laterally surrounding said decorative member, said bezel and said decorative member being thereby securely held in place between the upper surface of said plate and the lower surface of said top portion.

2. A ring according to claim 1 wherein said bezel comprises a frame and a flange portion which retains the decorative member within the bezel when the decorative member within the bezel is secured to the plate member.

3. A ring according to claim 1 wherein said top portion is integral with the two side members.

4. A ring according to claim 1 wherein said top portion has decorative members attached thereto.

5. A ring according to claim 1 wherein the decorative member is a precious stone.

6. A ring according to claim 1 wherein said decorative member is a semi-precious stone.

7. A ring according to claim 1 wherein said decorative member comprises a backing material on to which are secured pieces of stone.

* * * * *